US007096857B2

(12) United States Patent
Hlousek

(10) Patent No.: US 7,096,857 B2
(45) Date of Patent: Aug. 29, 2006

(54) SYSTEM FOR PRESSURE-MODULATED SHAPING OF THE COURSE OF INJECTION

(75) Inventor: Jaroslaw Hlousek, Golling (AT)

(73) Assignee: Robert Bosch GmbH, Stuttgart (DE)

( * ) Notice: Subject to any disclaimer, the term of this patent is extended or adjusted under 35 U.S.C. 154(b) by 14 days.

(21) Appl. No.: 10/504,962

(22) PCT Filed: Jan. 7, 2003

(86) PCT No.: PCT/DE03/00013

§ 371 (c)(1),
(2), (4) Date: Aug. 18, 2004

(87) PCT Pub. No.: WO03/074865

PCT Pub. Date: Sep. 12, 2003

(65) Prior Publication Data

US 2005/0115539 A1 Jun. 2, 2005

(30) Foreign Application Priority Data

Mar. 4, 2002 (DE) ..... 102 09 527

(51) Int. Cl.
*F02M 37/04* (2006.01)
*F02M 37/00* (2006.01)

(52) U.S. Cl. ..... 123/506; 123/514

(58) Field of Classification Search ..... 123/500–506, 123/496, 446, 514, 447, 456, 457
See application file for complete search history.

(56) References Cited

U.S. PATENT DOCUMENTS 4,325,340 A * 4/1982 O'Neill ..... 123/447
4,940,037 A * 7/1990 Eckert ..... 123/506
5,370,355 A 12/1994 Rembold et al.
5,642,716 A * 7/1997 Ricco ..... 123/456
5,771,865 A * 6/1998 Ishida ..... 123/467
6,273,066 B1 8/2001 Frankle et al.
6,308,689 B1 10/2001 Augustin
6,425,539 B1 7/2002 Boecking
6,431,148 B1 8/2002 Guggenbichler et al.
6,508,231 B1 1/2003 Boecking
6,513,497 B1 * 2/2003 Mahr et al. ..... 123/447
6,536,416 B1 3/2003 Mahr et al.
6,622,936 B1 * 9/2003 Boecking ..... 239/89

FOREIGN PATENT DOCUMENTS

EP 0 147 026 7/1985
EP 1 199 467 A2 4/2002

* cited by examiner

*Primary Examiner*—Mahmoud Gimie
(74) *Attorney, Agent, or Firm*—Ronald E. Greigg

(57) ABSTRACT

A system for injecting fuel into the combustion chamber of a self-igniting internal combustion engine, has a control unit which acts upon a spring-controlled injection device which includes a nozzle needle, by way of which one or more injection openings are opened or closed. The control unit includes a first valve and a second valve, which each include one pressure chamber which communicate with one another via a pressure line. The first valve and the second valve are connected in series, and the first valve controls the subjection of the pressure chamber of the second valve to pressure, and the level of the injection pressure during the injection phases is controlled by the second valve.

12 Claims, 6 Drawing Sheets

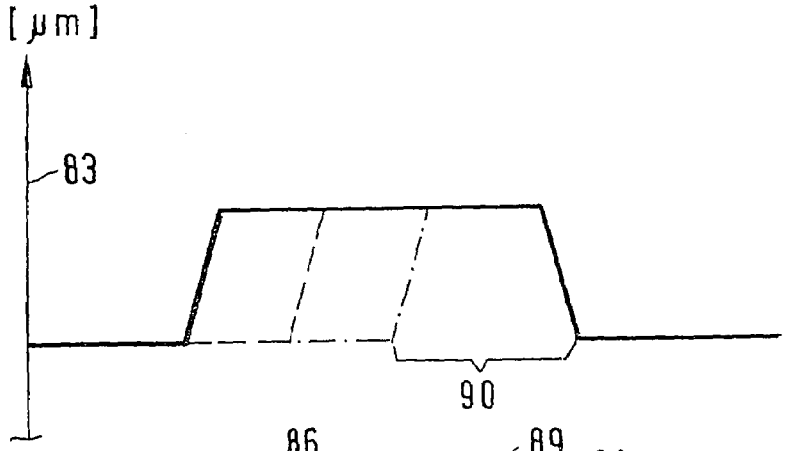
Fig. 5.1
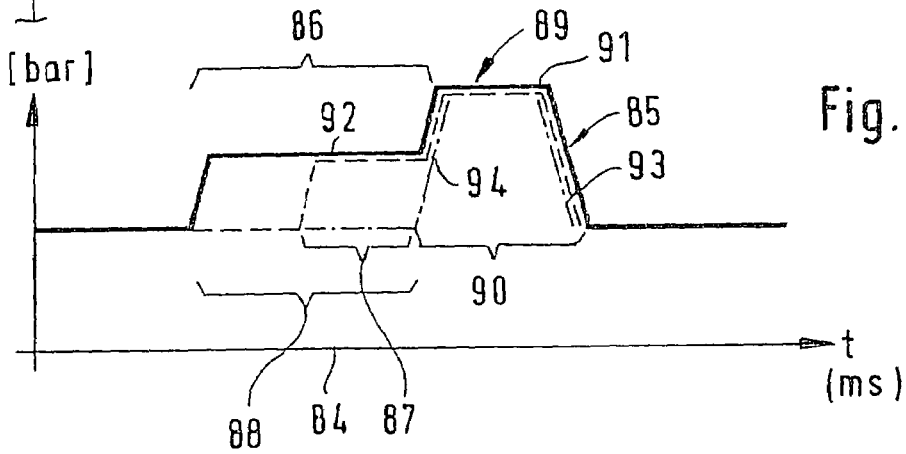
Fig. 5.2
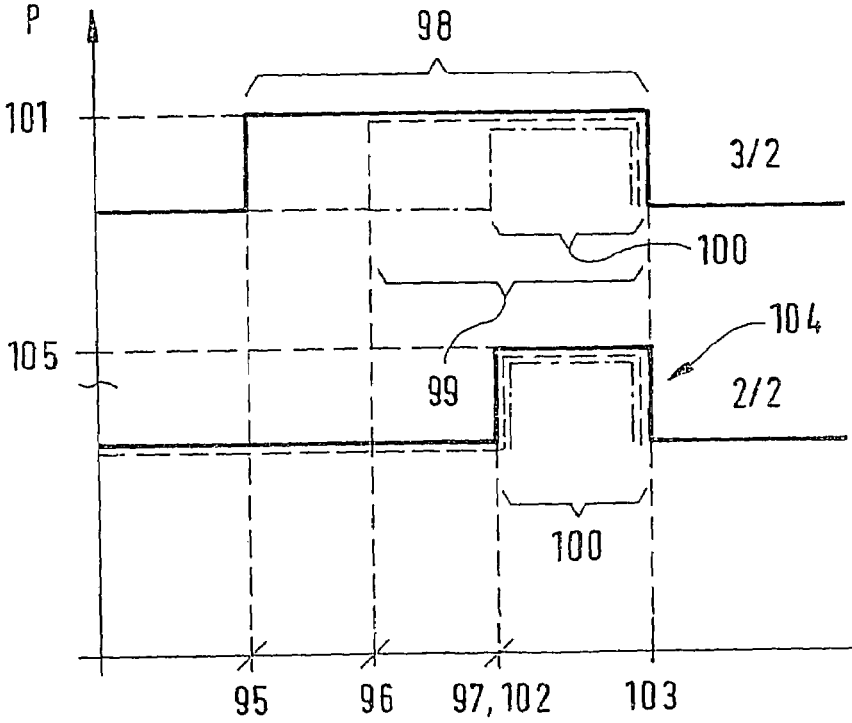
Fig. 5.3
Fig. 5.4

SYSTEM FOR PRESSURE-MODULATED SHAPING OF THE COURSE OF INJECTION

CROSS-REFERENCE TO RELATED APPLICATIONS

This application is a 35 USC 371 application of PCT/DE 03/00013 filed on Jan. 7, 2003.

BACKGROUND OF THE INVENTION

FIELD OF THE INVENTION

This invention relates to an improved system for pressure-modulated shaping of the course of iniection of fuel into the combustion chamber of a self-igniting internal combustion engine. The term "course of injection" means the course of the fuel quantity, injected into the combustion chamber, as a function of the crankshaft or camshaft angle. The essential variables are the duration of injection and the injection quantity. These represent the course of injection in degrees of crankshaft angle, camshaft angle, or milliseconds, during which the injection valves are opened and fuel reaches the interior of the combustion chamber.

DESCRIPTION OF THE PRIOR ART

German Patent Disclosure DE 198 37 332 A1 relates to a control unit for controlling the pressure buildup in a pump unit. The control unit has a control valve and a valve actuating unit communicating with it. The control valve is embodied as an inward-opening valve in terms of the flow direction and has a valve body, disposed axially displaceably in a housing of the control unit, that when the control valve is closed it is seated from the inside on a valve seat of the control valve. A throttle assembly is provided, by which the flow through the control valve, when the control valve is opened by a short stroke h, is throttled. With the control valve opened by this stroke length, the valve seat is open as it has been, but a further valve seat is closed, so that the pumped medium has to flow through the control valve via the throttle bores. Because of the thus-throttled flow through the control valve, a lesser pressure is built up in a high-pressure region of the system. Conversely, when the control valve is completely closed, both the first valve seat and the further valve seat are closed, thus disconnecting the bypass connection. The result is the buildup of a high pressure from the pump unit to the low-pressure region of the system in the high-pressure region of the system.

German Patent Disclosure DE 42 38 727 A1 refers to a magnet valve. The magnet valve serves to control the passage through a connection between a high-pressure chamber, which is at least intermittently brought to high fluid pressure, and in particular a pump work chamber of a fuel injection pump, and a low-pressure chamber. A valve body inserted into a valve housing and a bore in the valve body are provided; a valve closing member in the form of a piston is displaceable in this bore by an electromagnet, counter to the force of a restoring spring. The piston, beginning at a circular-cylindrical jacket face, tapers along a conical face to a reduced diameter; with a conical high-pressure chamber surrounding the circular-cylindrical jacket face of the piston, the conical face cooperates with a communicating valve seat on the valve body, which seat surrounds the reduced diameter of the piston. The cone angle of this seat is smaller than the cone angle of the conical face of the piston, and so the piston cooperates with the valve seat via a sealing edge created at the transition between its cylindrical jacket face and the conical face. In the overflow direction from the high-pressure chamber to the low-pressure chamber, the sealing edge is followed by a throttle restriction that becomes operative at the onset of the opening stroke. The throttle restriction is formed by a throttling segment in the area of overlap between the polygonal face of the piston and the valve seat face; the angle of the conical face of the piston is slightly greater, preferably 0.5 to 1° greater, than the angle of the valve seat face, so that the flow cross section between the conical face of the piston and the valve seat face decreases steadily over the entire circumference in the overflow direction to the low-pressure chamber at the onset of the opening stroke. Because of the high flow velocities of the fuels between the injection phases—whether they are the preinjection, main injection or postinjection phases—with this embodiment, cavitation damage can be prevented.

SUMMARY OF THE INVENTION

According to the present invention it is possible to control not only the control parameters of the injection onset, injection quantity, injection pressure, and number of injections, which in this connection are considered to be conventional control parameters of a common rail injection system, but also the first phase of the injection event (the so-called "boot phase") in terms of the length and the pressure level. Depending on the rpm and the load on the self-igniting internal combustion engine, $NO_x$ emissions can be affected quite favorably by means of the variation of the boot phase. The boot phase preceding the main injection serves to condition the mixture, to be converted during the main injection, in terms of an optimal or in other words as complete as possible combustion, with an optimal exhaust gas composition.

The possibility of influencing the boot phase in terms of its duration, independently of the control parameters of injection onset, injection quantity and injection pressure and so forth, makes it possible to adapt the course of injection to the fuel used during the boot phase as well. In stationary Diesel engines, or Diesel engines for driving ships, heavy oil is often used as fuel, whose atomization behavior compared to Diesel oil, which is injected into the combustion chambers of passenger car Diesel engines, is substantially poorer. Preparing the mixture by means of a controlled injection of fuel makes better preparation of the compressed mixture possible in a way that is independent of the fuel quality, so that during the combustion phase in the combustion chamber, favorable conditions are established in terms of emissions. Especially advantageously, the more-favorable $NO_x$ emissions can thus be attained for the same fuel consumption of the engines. This concept also makes it possible for multiple injections (preinjection phases) for the sake of preheating the mixture and a postinjection phase for reducing the smoke value to be combined with shaping of the course of injection.

The proposed invention moreover takes the use of heavy oil as a fuel for Diesel engines into account by providing that the actuating devices, such as magnet coils of electromagnets or piezoelectric actuators with hydraulic boosters, are separated from the fuel by diaphragms. The diaphragms for instance shield the armature plates and magnets from the fuel, which to improve its flow properties may be heated to temperatures of up to 140° C. and more.

BRIEF DESCRIPTION OF THE DRAWINGS

The invention is described in further detail below in conjunction with the drawings, in which:

FIGS. 5.1 and 5.2 show the courses of the nozzle needle stroke and the injection pressure, each plotted on the time axis;

FIG. 5.3 shows various triggering times of a 3/2-way valve;

FIG. 5.4, the triggering time of a 2/2-way valve that makes the full pressure buildup possible;

DESCRIPTION OF THE PREFERRED EMBODIMENTS

Figure 1:
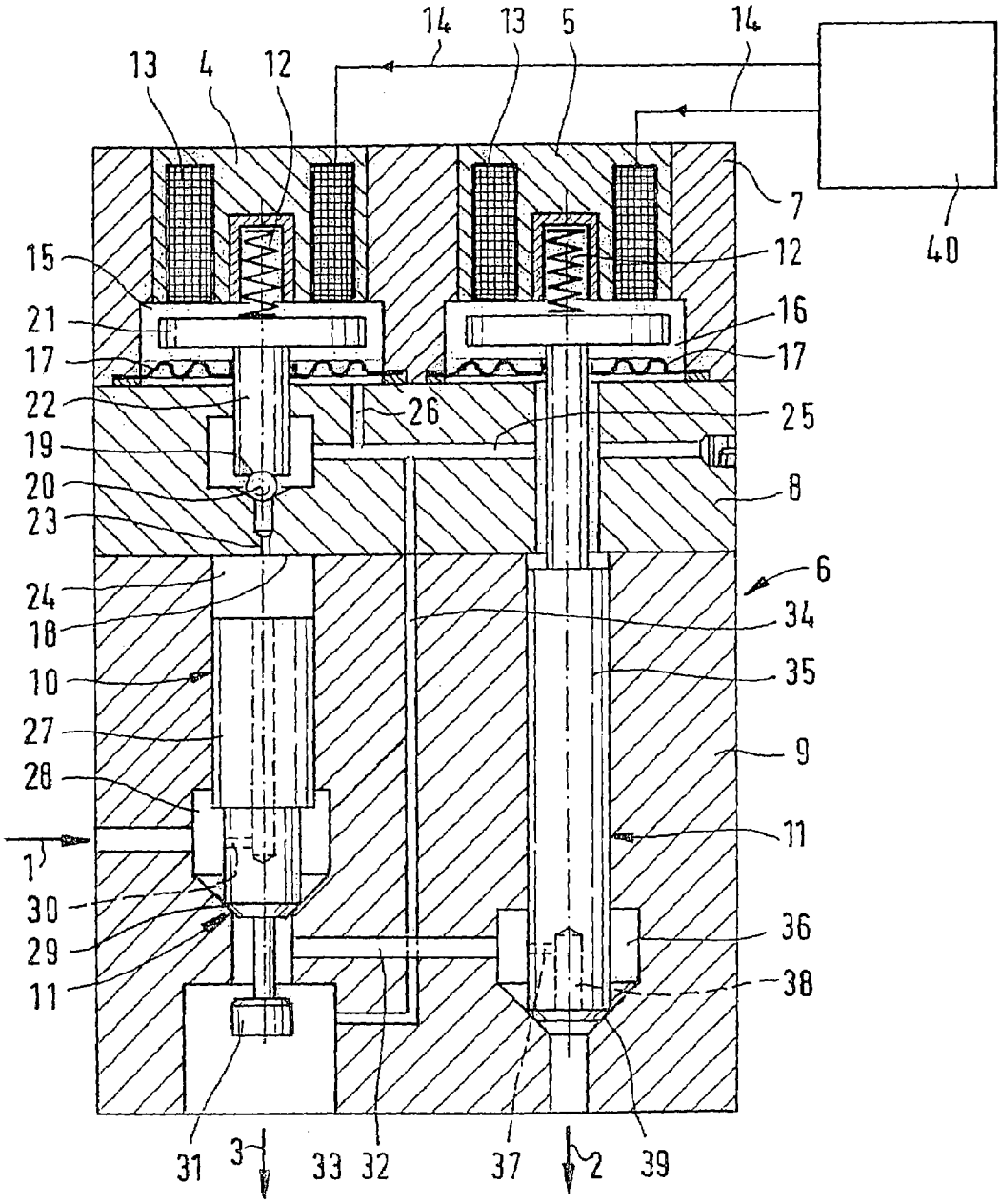
FIG. 1 is a sectional view of a control assembly with a series-connected combination of one 3/2-way valve and one 2/2-way valve.

FIG. 1 shows a control assembly with a series-connected combination of one 3/2-way valve and one 2/2-way valve. The control unit 6 is acted upon by fuel that is at high pressure via a common rail or other high-pressure source. The control unit 6 includes a pressureless outlet 3 and an outlet 2 on the high-pressure side. The control unit 6 is of modular construction and includes an upper part 7, in which a first actuating device 4 and a second actuating device 5 are received next to one another. Located below the upper part 7 of the control unit 6 is a middle part 8, which is adioined by a lower part 9.

The control unit 6 that can be seen in FIG. 1 is acted upon by fuel that is at high pressure via a common rail or other high-pressure source. The control unit 6 includes a pressureless outlet 3 and an outlet 2 on the high-pressure side. The control unit 6 is of modular construction and includes an upper part 7, in which a first actuating device 4 and a second actuating device 5 are received next to one another. Located below the upper part 7 of the control unit 7 is a middle part 8, which is adjoined by a lower part 9.

The control unit 6 includes a first valve 10 and a second valve 11. The first valve 10 is embodied as a 3/2-way valve, whose pressure chamber 28 is acted upon by fuel at high pressure via the high-pressure inlet 1. In comparison, the second valve 11 is embodied as a 2/2-way valve. The first valve 10 is controlled by the first actuating device 4, which in the view of FIG. 1 is designed as an electromagnet. The magnet coil 13 of the electromagnet is received in the upper part 7 of the control unit 6. An actuation assembly 21, 22 for pressure relief of a control chamber 24 of the first valve 10 acts upon a closing element 20, which in turn opens or closes an outlet throttle 23 for pressure relief of the control chamber 24 of the first valve 10. In the variant embodiment of the control unit 6 shown in FIG. 1, the first actuating device 4 is embodied as an electromagnet. Alternatively, it is possible to embody the first actuating device 4 as a piezoelectric actuator, which to increase the adjustment distance can be followed by a hydraulic booster. The actuating assembly 21, 22—embodied in the view of FIG. 1 as an armature plate 21 and a peg 22 joined to it—is acted upon via a restoring spring 12, which keeps the armature plate 21 of the actuating assembly 21, 22 at a distance from the lower end face of the magnet coil 13 of the first actuating device 4. The shaft 22 of the actuating assembly 21, 22 includes a contact face 19, which partly surrounds the closing element 20 that here is embodied spherically and presses it into the seat inside the middle part 8 that closes the outlet of the control chamber 24. Reference numeral 18 indicates the line of separation between the upper part 7 and middle part 8, and defines a stop face.

Below the first actuating device 4, a first hollow chamber 15 is embodied in the upper part 7 of the control unit 6 and serves to receive the armature plate 21 of the actuating assembly 21, 22. In the region above the parting joint of the upper part 7 and the middle part 8 of the control unit 6, the first hollow chamber 15 is sealed off from the entry of fuel by means of a flexible diaphragm element 17. When the control unit 6 is used with large Diesel engines, of the kind used for instance as stationary Diesel engines or for driving ships, heavy oil is used as fuel, which is preheated to temperatures of up to 140° C. and more in order to improve its flow properties. To protect the first actuating device 4—and analogously the second actuating device 5, which actuates the second valve 11—against damage and the entry of viscous fuel, the first hollow chamber 15 and analogously the second hollow chamber 16 of the second actuating device 5 are protected against the entrance of hot fuel by means of flexible diaphragm elements 17 in the region of the parting joint to the middle part 8 of the control unit 6.

The control quantity diverted upon pressure relief of the control chamber 24 of the first valve 10, which is preferably embodied as a 3/2-way valve, enters into the annular chamber surrounding the shaft 22 of the actuating assembly 21, 22 and flows from there into an overflow bore 25 extending horizontally in the middle part 8. From the horizontally extending overflow bore 25 in the middle part 8 of the control unit 6, both an overflow bore 26 extending in the vertical direction in the middle part 8 and an outflow line 34 branch off. Via the outflow line 34, the diverted fuel volume, flowing out of the control chamber 24, can be introduced into the pressureless outlet 3, from which the diverted fuel volume flows back into the fuel tank.

The first valve 10 includes a valve body 27, whose upper face end defines the control chamber 24. The control chamber 24 is furthermore defined by the lower part 9 of the control unit 6 and a portion of the lower face of the middle part 8 of the control unit 6 in which portion the outlet throttle 23 is accommodated that can be opened and closed by the closing element 20, configured spherically in this case. Furthermore, in the region surrounded by the annularly configured pressure chamber 28, the valve body 27 of the first valve 10 includes an inlet throttle restriction 30, which communicates with a longitudinal bore that discharges at the upper face end of the valve body 27. Via the high-pressure inlet 1, the inlet throttle restriction 30 and the aforementioned longitudinal bore, shown in dashed lines in FIG. 1, it is assured that the control chamber 24 of the first valve 10 is constantly subjected to a control pressure. Furthermore, the valve body 27 of the first valve 10 includes a conical seat 29 that cooperates with a corresponding seat face of the lower part 9. In FIG. 1, the conical seat 29 of the valve body 27 has moved into a seat face, corresponding to it, of the lower part 9 of the control unit 6 and closes off both the pressureless outlet 3 and the transverse bore 32, branching off underneath the annularly extending pressure chamber 28, to the pressure chamber 36 of the second valve 11, which is preferably embodied as a 2/2-way valve. The valve body 27 of the first valve 10 furthermore includes an extension 31, which is disposed below the conical seat 29 and closes or opens the pressureless outlet 3 in accordance with the stroke length of the valve body 27 in the lower part 9 of the control unit 6. Upon applying current to the first actuating device 4, the control chamber 24 is pressure-relieved, and accordingly the valve body 27 moves vertically upward until its upper face end contacts the stop face 18 of the middle part 8. In accordance with this vertical stroke motion, the conical seat 29 moves out of its seat face in the lower part 9 of the control unit 6, and the extension 31 moves partway into the bore adjoining the pressure chamber 28, precisely far enough that, via the annular pressure chamber 28, the high-pressure inlet 1 and the transverse bore 32 that acts upon the pressure chamber 36 of the second valve 11 are supplied with high pressure.

The second actuating device 5, likewise accommodated in the upper part 7 of the control unit 6 and likewise embodied as a magnet valve in the variant embodiment of FIG. 1, actuates a valve body 35 of the second valve 11. Below the magnet coil 13 of the second actuating device 5, there is a second hollow chamber 16 embodied in the upper part 7; it is protected against the inflow of preheated fuel via the diaphragm element 17. If fuel were to flow in and then cool down, given the short stroke lengths and the adjusting travel distances or lengths that the electromagnet requires to actuate the first valve 10 and the second valve 11, operation with the requisite precision would no longer be feasible if preheated heavy oil were used as fuel, which is quite usual in stationary large Diesel motors as well as in Diesel motors used to drive ships.

The pressure chamber 36 of the second valve 11, acted upon via the transverse bore 32, discharges into a high-pressure outlet 2, which is in communication with a nozzle chamber, not shown in FIG. 1, an injection device, such as a nozzle holder combination or an injector. A conical seat 39 is embodied on the end of the valve body 35 of the second valve 11 pointing toward the high-pressure outlet 2 and cooperates with a corresponding seat face in the lower part 9 of the control unit 6. In the lower region of the valve body 35, a throttle restriction 37 is embodied, which communicates with the pressure chamber 36 and with a longitudinal bore 38 inside the valve body 35.

Both the first actuating device 4 and the second actuating device 5 are triggered by means of a triggering part 40, which communicates via triggering lines 14 with the magnet coils 13 of the first actuating device 4 and second actuating device 5, respectively.

The mode of operation of the variant embodiment shown in FIG. 1 is as follows:

The valve body 27 of the hydraulic 3/2-way valve 10 is controlled by means of the first actuating device 4, embodied as an electromagnet. The opening and closing of the valve body 27 is controlled by the pressure relief of the control chamber 24 via the first actuating device 4. The pressure drop or pressure rise is independent of the diameters of the inlet throttle restriction 30 in the lower part of the valve body 27 and of the design of the outlet throttle 23 above the control chamber 24. If no current is supplied to the magnet coil 13 of the first actuating device 4, the valve body 27, by movement of its conical seat 29 into the corresponding seat face inside the lower part 9 of the control unit 6, closes off the high-pressure inlet 1 via the transverse bore 32 to the pressure chamber 36 of the second valve 11. The high-pressure outlet 2 of the second valve 11, in this state, communicates with the pressureless outlet 3 below the first valve 10. By way of outlet 3, the control volume quantity diverted from the control chamber 24 in its pressure relief also flows to the low-pressure side of the control unit 6 via the horizontally extending overflow bore 25 or the outflow line 34. In this state, a nozzle needle of an injection device remains closed; see FIGS. 2 and 3. Upon the activation of the first actuating device 4 initiated via the triggering part 40, that is, upon excitation of the magnet coil 13, the valve body 27 is moved as far as the stop 18. By inward motion, effected in accordance with the stroke length, of the extension 31 into the bore adjoining the pressure chamber 28 underneath, a closure of the pressureless outlet 3 ensues; the high-pressure inlet 1 communicates via the pressure chamber 28 with the pressure chamber 36 of the second control valve 11. The onset of the injection event now occurs. The injection pressure is controlled via the second actuating device 5, which actuates the valve body 35 of the second valve 11 and whose magnet coil is activated by the triggering part 40 via a triggering line 14. In the closed state of the second valve 11, that is, when the magnet coil 13 of the second actuating device 5 is not activated, the inlet to the injection nozzle is throttled via the throttle restriction 37 embodied in the valve body 35. With the triggering sequence described, that is, a supply of current to the magnet coil 13 of the first actuating device 4 and an ensuing pressure relief of the control chamber 24, it is true that the high-pressure inlet 1 is indeed in communication with the pressure chamber 36 of the second valve 11 via the pressure chamber 28 and the transverse bore 32, but in this phase of the injection only a throttled action by the high-pressure inlet 2 on the injection nozzle occurs (see the illustration in FIG. 2). As a function of the actuation of the second actuating device 5 via the triggering part 40, an unthrottled action on the nozzle holder combination 56 (see the illustration in FIG. 2) for the nozzle chamber 59 can be done depending on the triggering, that is, on the stroke length of the valve body 35 of the second valve 11 inside the lower part 9 of the control unit 6. Upon opening of the second valve 11, the injection nozzle at the nozzle holder combination (see FIGS. 2 and 3) communicates unthrottled with the high pressure source via the high-pressure inlet 1, the pressure chamber 28 of the first valve 10, the transverse bore 32, and the pressure chamber 36 of the second valve 11. For termination of the injection, the high-pressure outlet 2 leading to the nozzle holder combination or to the injector 56 (see the illustration in FIG. 2) is opened by actuation of the valve body 27 of the first valve 10, preferably embodied as a 3/2-way valve, that is, by movement of the conical seat 29 into the seat face located in the lower part 9, as a result of which the high-pressure outlet 2 along with the pressureless outlet 3 is pressure-relieved for pressure relief of the device for injecting fuel 56. After that, via the restoring spring 12, which is received by the magnet coil 13 surrounded in the upper part 7 of the control unit 6, valve 11 is closed.

Figure 2:
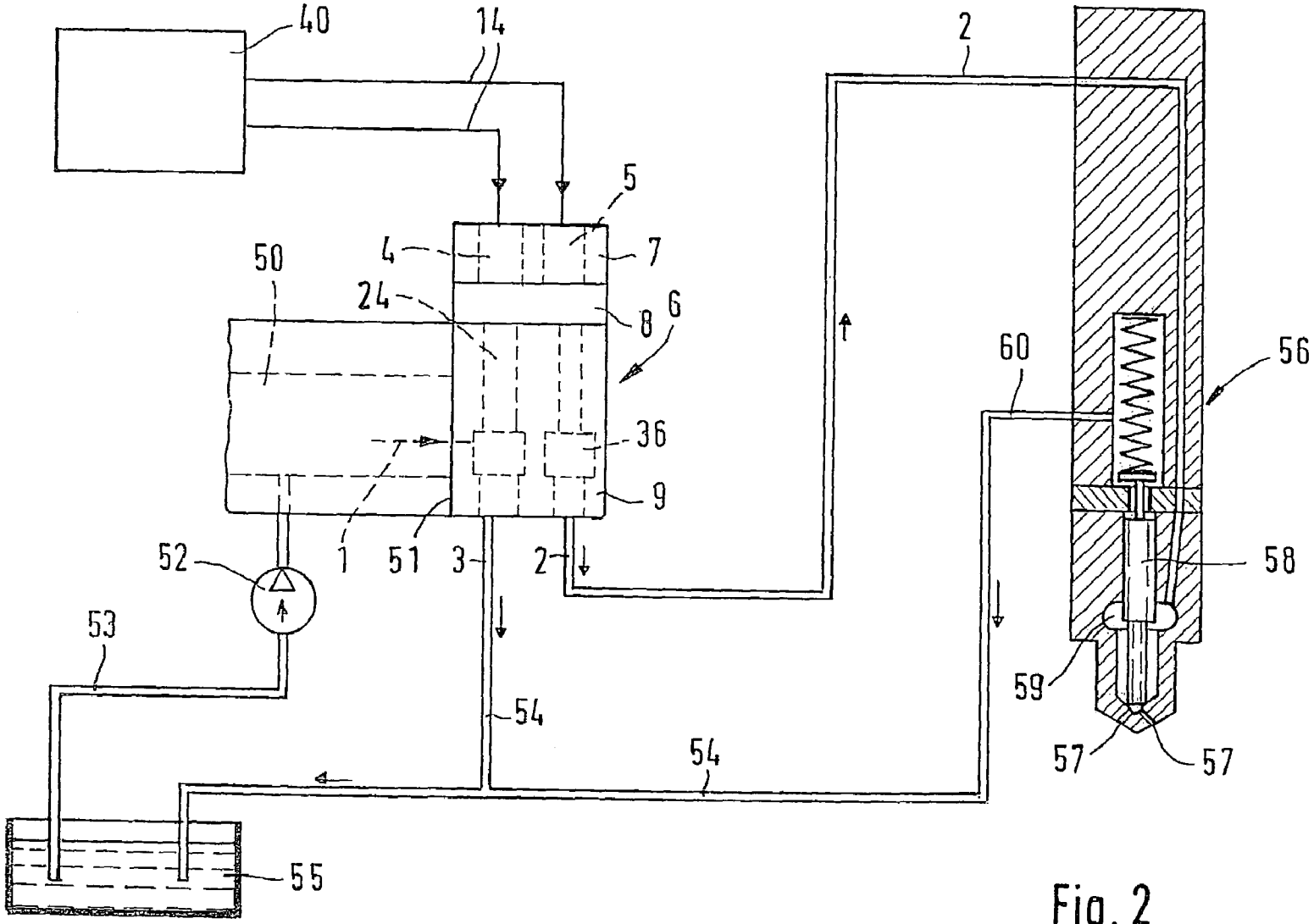
FIG. 2, the control assembly of FIG. 1, secured to a high-pressure collection chamber (common rail)

FIG. 2 shows the control unit of FIG. 1, secured to a high-pressure collection chamber (common rail). As illustrated, the control unit 6 is represented only by its upper part 7, middle part 8, and lower part 9. The common rail 50 is configured essentially in tubular form. Along a butt joint 51, the common rail 50 and the control unit 6 communicate with one another. Above the control unit 6, the triggering lines 14 of the first actuating device 4 and of the second actuating device 5 in the upper part of the control unit 6 are shown, by way of which the magnet valves for actuating the first valve 10 and the second valve 11 are triggered by means of the triggering part 40.

The common rail 50 communicates with the tank 55 via a forward fuel flow 53 and includes a high-pressure fuel pump 52, which brings the fuel from the tank 55 to an arbitrary pressure level, for instance between 600 and 1800 bar.

The pressureless outlet 3 at the control unit 6 likewise communicates with the tank 55, via a return line 54, so that the fuel quantity diverted from the control chamber 24 of the first valve 10 can return to the fuel reservoir again. Subjection of the pressure chamber 36 of the second valve 11 to pressure causes high pressure to prevail at the high-pressure outlet 2 of the control unit 6, and in accordance with the further course of the high-pressure outlet 2 this pressure also prevails at the nozzle chamber 59 of the nozzle holder combination 56. Reference numeral 56 indicates a nozzle holder combination which includes a nozzle needle 58, which is subjected to a compression spring inside the nozzle holder combination 56. Depending on the pressure to which the nozzle chamber 59 is subjected, injection openings 57 disposed on the end toward the combustion chamber of the nozzle holder combination 56 are supplied with fuel or closed. Via a further pressureless outlet 60, the spring chamber of the nozzle holder combination 56 communicates with the return flow 54 to the fuel tank 55, so that excess fuel volume can likewise flow back into the tank 55. In the illustration in FIG. 2, the control unit 6 is associated directly with the common rail 50, and as a result a short structural length of the high-pressure inlet 1 from the common rail 50 to the control unit 6 can be achieved.

Figure 3:
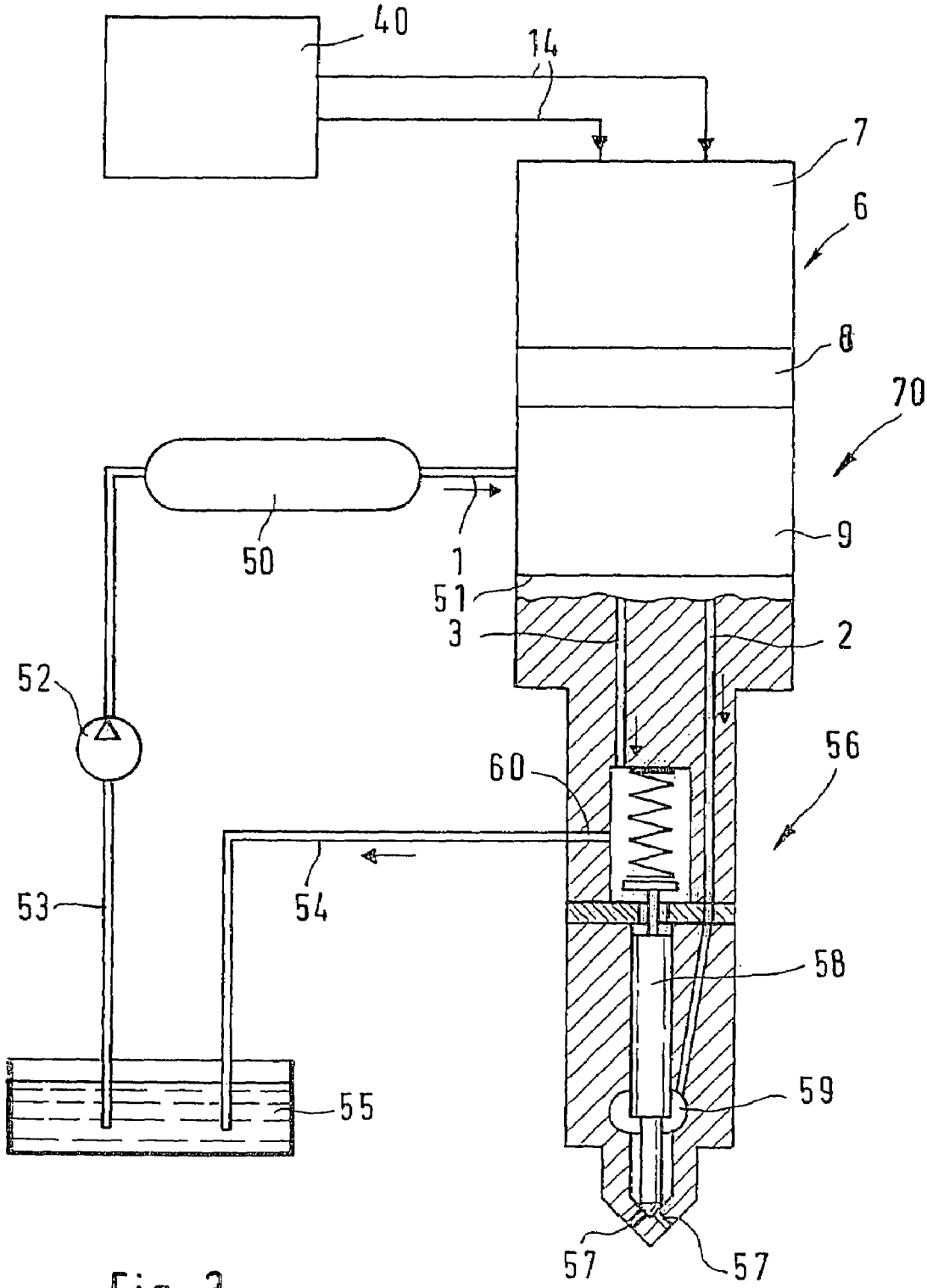
FIG. 3, the control assembly of FIG. 1, associated directly with an injector (nozzle holder combination)

The illustration in FIG. 3 shows the control unit of FIG. 1, which is disposed directly above an iniector (nozzle holder combination). This integrated version, identified by reference numeral 70, of a control unit 6 in the upper region of a nozzle holder combination 56 or of some differently configured device for injecting fuel into the combustion chambers of a self-igniting internal combustion engine, is triggered analogously to what is shown in FIG. 2 via triggering lines 14 by means of a triggering part 40. Analogously to what FIG. 2 shows, the common rail 50 is subjected via a high-pressure fuel pump 52 to a fuel volume at high pressure, which the high-pressure fuel pump 52 in turn pumps out of the tank 55 via a forward flow 53. A pressureless outlet 60 of the device 56 for injecting fuel, here embodied as a nozzle holder combination, discharges into the tank 55. From the pressureless outlet 3 of the control unit 6, which in the variant embodiment of FIG. 3 discharges into the spring chamber of the nozzle holder combination 56, the leak fuel volume flows back to the tank 55, via the pressureless outlet 60 and the return flow 54. As a result of the integrated version 70 of the control unit 6 above a device 56 for injecting fuel, an especially short high-pressure outlet 2 is advantageously obtained, by way of which the nozzle chamber 59 that surrounds the nozzle needle 58 can be acted upon by high pressure. In its integrated version 70 as well, the control unit 6 has an upper part 7, the middle part 8, and the lower part 9, this last part receiving both the first valve 10 and the second valve 11, the latter not shown in FIG. 3.

Figure 4:
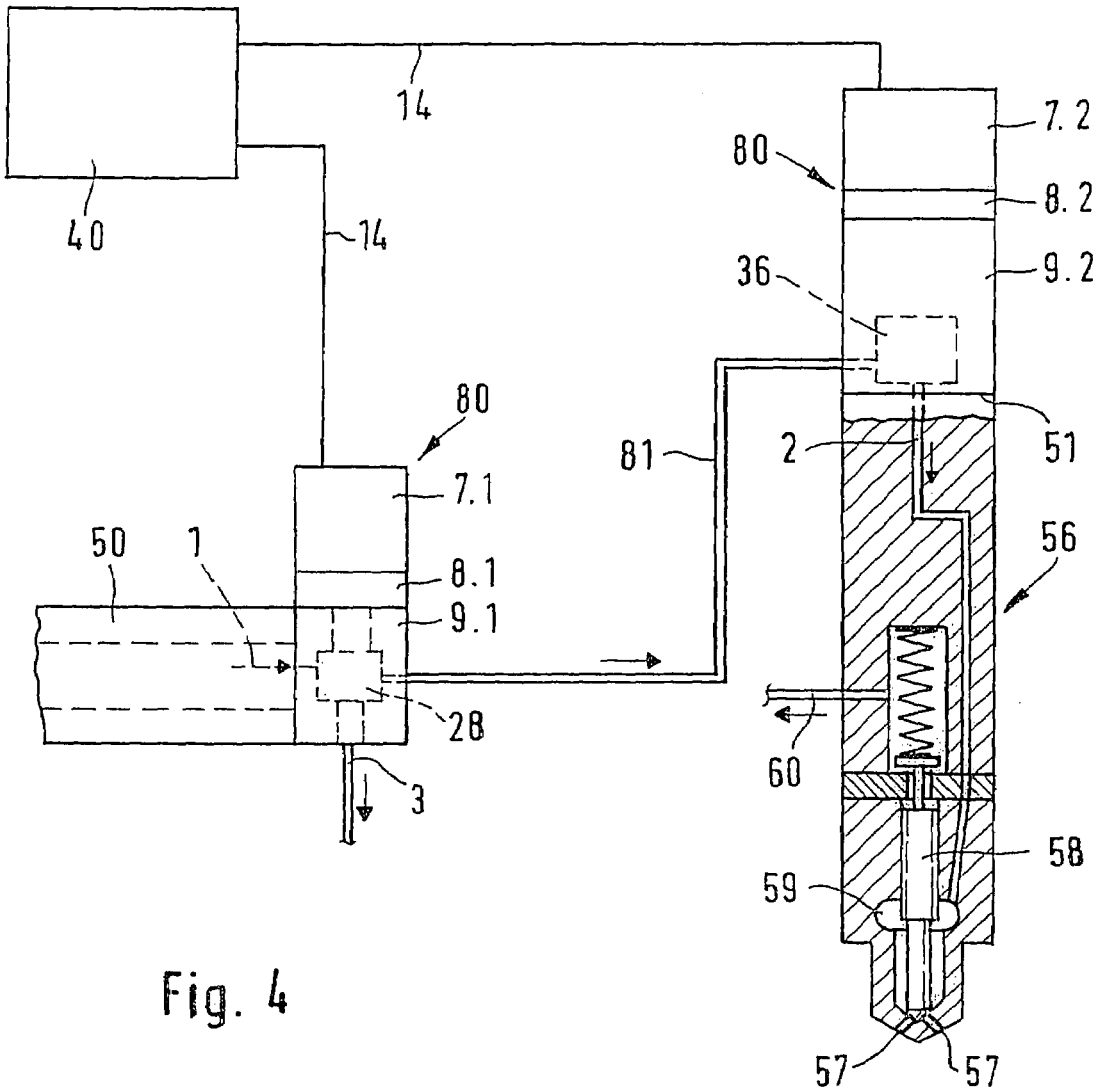
FIG. 4, a variant embodiment of the control assembly of FIG. 1 in split form, in which one part of the control assembly is associated with the common rail and the other part of the control assembly is associated with the injector (nozzle holder combination)

FIG. 4 shows a variant embodiment of the control unit in split form, in which one part of the control unit is associated directly with the common rail and the other part of the control unit is associated directly with the injector.

The variant embodiment of the control unit 6 in split form is identified by reference numeral 80. In this variant embodiment, the control unit 80 includes two components, and the first valve 10 and the first actuating device 4 that actuates it are received in the upper part 7.1, the middle part 8.1, and the lower part 9.1. The common rail 50 communicates directly with the lower part 9.1 of the control unit 80. From the lower part 9.1 of the split control unit 80, that is, from the pressure chamber 28 of the first valve 10, a connecting line 81 branches off, by way of which the pressure chamber 36 of the second valve 11, which is contained in the second part of the split embodied control unit 80, is acted upon by fuel that is at high pressure.

The second valve 11, preferably embodied as a 2/2-way valve, is accommodated in the upper part 7.2, middle part 8.2, and lower part 9.2 of the variant embodiment of the control unit 80 in split form. The high-pressure outlet 2, which subjects the nozzle chamber 59 of the nozzle holder combination 56 to high pressure, branches off from the pressure chamber 36 of the second valve 11. In accordance with the stroke motion of the nozzle needle 58 counter to the spring prestressing, the injection openings 57 on the end toward the combustion chamber of the nozzle holder combination 56 are either subjected to fuel or closed. Reference numeral 60 indicates a pressureless outlet, by way of which excess fuel volume flows back into a tank, not shown here.

FIGS. 5.1 and 5.2 show the courses of the nozzle needle stroke and the injection pressure, each plotted over the time axis.

In the graph in FIG. 5.1, the needle stroke length 23 can be seen plotted over the time axis 84. As can be seen from FIG. 5.1, with the embodiment proposed according to the invention, both short boot phases 87 and intentionally longer boot phases 88 can precede a main injection 90. The curves in FIG. 5.2 show the pressure level 92 which is attained during the boot phase 86 preceding the main injection 90, whether it is dimensioned as a short boot phase 87 or a long boot phase 88. The pressure level 92 during the boot phase 86 is adjustable with the throttle 37 shown in FIG. 1 in proportion to the system pressure 91, that is, the maximum pressure and is dependent on the through stroke and throttle size.

In comparison to the pressure level 89 prevailing during the main injection phase 90, in which the maximum level prevails, the injection pressure during the boot phases 86 proceeds at a lower pressure level 92. Within the boot phase, a small quantity of fuel comes to be injected into the combustion chamber; this serves essentially to improve the turbulence of the compressed air inside the combustion chamber, and its purpose is conditioning the air mixture to bring about an ensuing optimal combustion during the main injection phase 90. The course of the main injection phase 90 is characterized by a pressure maximum 89, a descending pressure edge 93 and a steeply rising pressure edge 94 at the onset of the main injection phase 90. The maximum pressure level 91 established during the main injection phase 90 is essentially equivalent to the pressure maximum 89 that is established inside the common rail 50.

FIG. 5.3 shows various triggering times of a 3/2-way valve, which define the injection pressure course and the injection quantity.

Reference numeral 95 marks a first injection onset of the first valve 10, which is designed as a 3/2-way valve, while reference numeral 103 identifies the end of a first injection pressure course 98. The first injection onset 95 is tripped by the triggering instant, or time, of the electromagnet 13 that triggers the first valve 10. Depending on the triggering time, a second injection onset 96 and a third injection onset 97 can also be defined, as a result of which—while keeping the end of injection 103 unchanged—injection pressure courses 98, 99, 100 of various lengths can be achieved, and by means of them the quantity of fuel delivered to the combustion chamber of an internal combustion engine is determined.

The pressure level that is reached upon triggering of the first valve 10 by the electromagnet 13 is identified by reference numeral 101.

FIG. 5.4 shows the triggering time of the second valve 11, which is embodied as a 2/2-way valve. This valve is opened by the electromagnet 13 at time 102 and closed by the electromagnet at time 103. During the period of time identified by reference numeral 100, both valves are open, so that during this phase, the pressure maximum 89 of FIG. 5.3 is established, at which the two pressure levels 101 and 105 at the 3/2-way valve and at the 2/2-way valve, respectively, that is, at the first valve 10 and second valve 11, are superimposed on one another. Depending on the triggering time 90, the boot phase 86 preceding the main injection phase 50 can be shaped as a short boot phase 87 or a long boot phase 88, in which the first pressure level 101 applied upon opening of the first valve 10 embodied as a 3/2-way valve prevails.

If as in FIG. 4 the first valve 10 and the second valve 11 are opened and closed simultaneously, as indicated by the curve course 104, then a main injection without a preceding boot phase 86 as in FIG. 5.2 is established.

Figure 6:
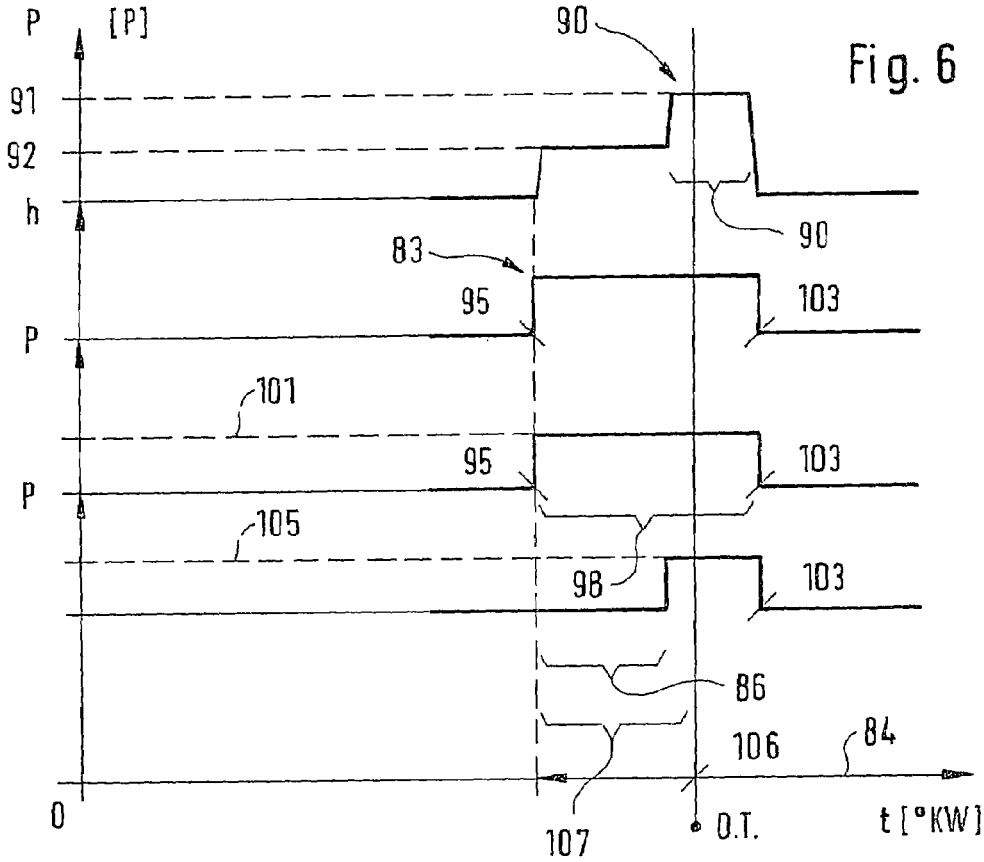
FIG. 6, the courses of the pressure, needle stroke, and triggering times of a 3/2-way valve and a 2/2-way valve.

FIG. 6 shows the courses of the pressure and needle stroke and the triggering times of a 3/2-way valve and a 2/2-way valve, in multiple injection with boot rate shaping.

Figure 7:
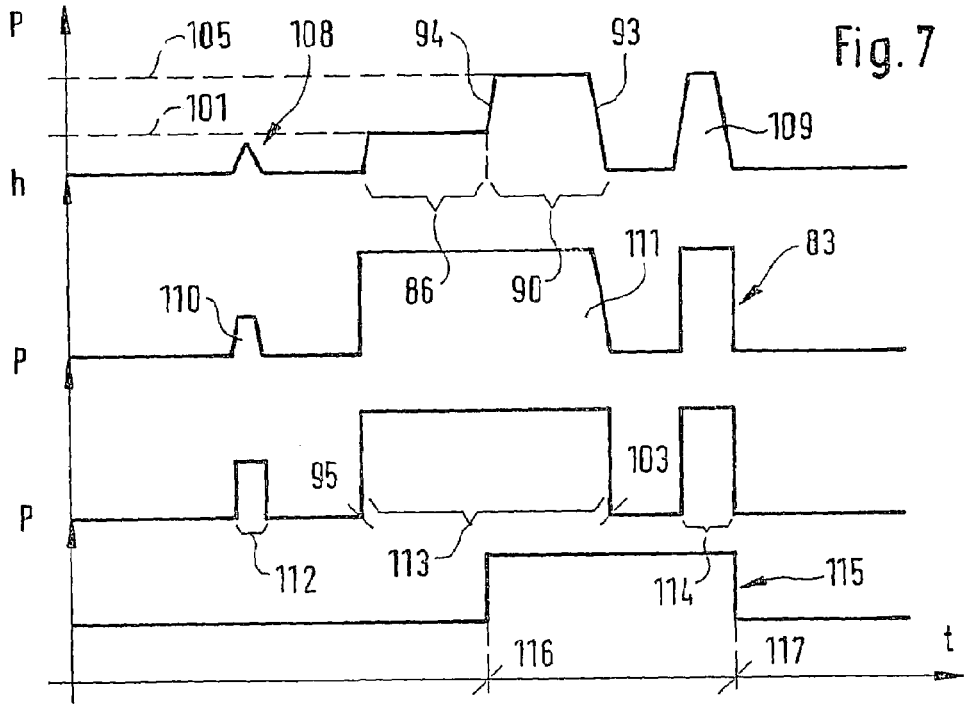
FIG. 7, the courses of the pressure, needle stroke, and triggering times of a 3/2-way valve and a 2/2-way valve in the case of multiple injection, combined with boot rate shaping.

In FIG. 6, the aforementioned parameters are shown relative to the top dead center (O.T.) 106 of a piston in the cylinder of an internal combustion engine. It can be seen from the upper curve course in FIG. 7 that a preinjection 108 and a postinjection 109 are both associated with a main injection phase 90 with a preceding boot phase 86. During the preinjection 108, the nozzle needle, which for instance represents the injection valve member of an injector, is partway open, represented by reference numeral 110; during the period of time indicated by reference numeral 111, the nozzle needle is completely open, in accordance with the course 83 of the needle stroke length in FIG. 7. With the 2/2-way valve 11, the length of the boot phase 86 can be controlled in synchronism with the first valve 10 upon changes in the injection onset.

During the preinjection 108, the first valve 10, embodied as a 3/2-way valve, is briefly opened for the duration 112 and is then closed again, as a result of which a slight quantity of fuel for preconditioning is injected into the combustion chamber of the engine. At the time marked by reference numeral 95, the 3/2-way valve opens for the duration of the main injection phase 113 and closes again at time 103. During the postinjection phase 109, the 3/2-way valve, that is, the first valve 10, is opened for the duration 114. The 2/2-way valve, that is, the second valve 11, is opened at time 116 and not closed again until time 117, times that are shifted relative to the opening time 95 and closing time 103 of the first valve 10; in the shifted opening duration course of the 2/2-way valve 115 shown in FIG. 7, this closing time can coincide with the end of the postinjection phase 114.

As a result of the shift in the opening and closing times 116 and 117, respectively, of the 2/2-way valve, that is, the second valve 11, boot rate shaping can be achieved; that is, the course of the injection pressure, and thus the injection quantity, can both be shaped in accordance with predetermined conditions and criteria. From the curve courses shown in FIG. 7, it can also be seen that a main injection phase 90, either with or without a boot phase 86, can be preceded and followed by both a preinjection 108 and a postinjection 109.

The foregoing relates to preferred exemplary embodiments of the invention, it being understood that other variants and embodiments thereof are possible within the spirit and scope of the invention, the latter being defined by the appended claims.

The invention claimed is:

1. In a system for injecting fuel into the combustion chamber of a self-igniting internal combustion engine, having a control unit (6, 80), which acts upon a spring-controlled injection device (56) which includes a nozzle needle (58), the control unit (6, 80) including a first valve (10) and a second valve (11), which each include one pressure chamber (28, 36) which communicate with one another via a pressure line (32, 81), the improvement wherein the first valve (10) and the second valve (11) are connected in series, and the first valve (10) controls the subjection of the pressure chamber (36) of the second valve (11) to pressure, and the level (91, 92) of the injection pressure during the injection phases (86, 87, 88; 90) is controlled by the second valve (11), wherein the second valve (11), which can be acted upon via the first valve (1O), is embodied as a 2/2-way valve, from whose pressure chamber (36) a high-pressure outlet (3) extends to the nozzle chamber (59) of the injection device (56), and wherein the second valve (11) comprising a valve body (35) including a conical seat (39) above which a throttle restriction (37) is disposed that communicates with a longitudinal bore (38) pointing toward the high-pressure outlet (2).

2. The system for injecting fuel of claim 1, wherein the control unit (6, 80) comprises actuating devices (4, 5) for the first valve (10) and the second valve (11), which actuating devices are each separated from the fuel via a respective diaphragm element (17).

3. The system for injecting fuel of claim 2, wherein the diaphragm elements (17) are received on an upper part (7, 7.1, 7.2) of the control unit (6) above a parting joint to a middle part (8, 8.1, 8.2) of the control unit (6, 80).

4. The system for injecting fuel of claim 1, wherein the control unit (6, 80) is received on the common rail (50).

5. The system for injecting fuel of claim 1, wherein the control unit (6) is disposed directly above the injection device (56).

6. The system for injecting fuel of claim 1, wherein the control unit (80) is embodied in split form, and wherein one part (7.1, 8.1, 9.1) receiving the first valve (10) is on the common rail (50), and the part (7.2, 8.2, 9.2) receiving the second valve (11) is associated with the injection device (56).

7. The system for injecting fuel of claim 6, wherein the pressure chambers (28, 36) of the first valve (10) and the second valve (11) communicate via a line connection (81).

8. The system for injecting fuel of claim 1, further comprising one control unit (6, 80) and one injection device (56) assigned to each cylinder of a self-igniting internal combustion engine.

9. In a system for injecting fuel into the combustion chamber of a self-igniting internal combustion engine, having a control unit (6, 80), which acts upon a spring-controlled injection device (56) which includes a nozzle needle (58), the control unit (6, 80) including a first valve (10) and a second valve (11), which each include one pressure chamber (28, 36) which communicate with one another via a pressure line (32, 81), the improvement wherein the first valve (10) and the second valve (11) are connected in series, and the first valve (10) controls the subjection of the pressure chamber (36) of the second valve (11) to pressure, and the level (91, 92) of the injection pressure during the injection phases (86, 87, 88; 90) is controlled by the second valve (11), and wherein the first valve (10) is a 3/2-way valve, whose pressure chamber (28) is acted upon via a hi2h-pressure inlet (1), and wherein both a closable, pressureless outlet (3) and the pressure line (32, 81) branch off underneath the pressure chamber (28), and wherein the first valve (10) comprises a valve body (27) having a conical seat (29) which closes both the pressure line (32) and the pressureless outlet (3), and wherein the valve body (27) comprises an inlet throttle (30), which communicates via a conduit with a control chamber (24) that can be pressure-relieved by an actuating device (4).

10. The system for injecting fuel of claim 9, further comprising an overflow bore (25) and an outflow line (34), whereby a control quantity, diverted via an outlet throttle (23) upon pressure relief of the control chamber (24), is diverted into the pressureless outlet (3).

11. In a system for injecting fuel into the combustion chamber of a self-igniting internal combustion engine, having a control unit (6, 80), which acts upon a spring-controlled injection device (56) which includes a nozzle needle (58), the control unit (6, 80) including a first valve (10) and a second valve (11), which each include one pressure chamber (28, 36) which communicate with one another via a pressure line (32, 81), the improvement wherein the first valve (10) and the second valve (11) are connected in series, and the first valve (10) controls the subjection of the pressure chamber (36) of the second valve (11) to pressure, and the level (91, 92) of the injection pressure durin2 the injection phases (86, 87, 88; 90) is controlled by the second valve (11), and wherein the first valve (10) is a 3/2-way valve, whose pressure chamber (28) is acted upon via a high-pressure inlet (1), and wherein both a closable, pressureless outlet (3) and the pressure line (32, 81) branch off underneath the pressure chamber (28), and wherein the first valve (10) comprises a valve body (27) having a conical seat (29) which closes both the pressure line (32) and the pressureless outlet (3), and wherein the valve body (27) includes an extension (31), which closes and opens the pressureless outlet (3) as a function of the stroke length of the valve body (27), wherein the extension (31) extends from the conical seat.

12. In a system for injecting fuel into the combustion chamber of a self-igniting internal combustion engine, having a control unit (6, 80), which acts upon a spring-controlled injection device (56) which includes a nozzle needle (58), the control unit (6, 80) including a first valve (10) and a second valve (11), which each include one pressure chamber (28, 36) which communicate with one another via a pressure line (32, 81), the improvement wherein the first valve (10) and the second valve (11) are connected in series, and the first valve (10) controls the subjection of the pressure chamber (36) of the second valve (11) to pressure, and the level (91, 92) of the injection pressure during the injection phases (86, 87, 88; 90) is controlled by the second valve (11), and wherein the first valve (10) is a 3/2-way valve, whose pressure chamber (28) is acted upon via a high-pressure inlet (1), and wherein both a closable, pressureless outlet (3) and the pressure line (32, 81) branch off underneath the pressure chamber (28), and wherein the first valve (10) comprises a valve body (27) having a conical seat (29) which closes both the pressure line (32) and the pressureless outlet (3), and wherein the stroke length of the valve body (27) of the first valve (10) is defined by a stop face (18), which is formed by a middle part (8) of the control unit (6, 80).

* * * * *